United States Patent [19]

Noordermeer

[11] Patent Number: 4,880,164

[45] Date of Patent: Nov. 14, 1989

[54] ONE-PIECE HIGH-SOLIDS NEBULIZER

[76] Inventor: Michael N. A. Noordermeer, 22 Sirrah Street, Geebung, Queensland, 4034, Australia

[21] Appl. No.: 204,733

[22] Filed: Jun. 10, 1988

[51] Int. Cl.[4] ..... B05B 7/08

[52] U.S. Cl. ..... 239/423; 239/426; 239/600; 239/DIG. 19

[58] Field of Search ..... 239/426, 423, 434, 433, 239/DIG. 19, 600

[56] References Cited

U.S. PATENT DOCUMENTS

| | | | |
|---|---|---|---|
| 493,512 | 3/1893 | McElroy | 239/434 |
| 760,826 | 5/1904 | Von Boden | 239/423 |
| 870,402 | 11/1907 | Witt | 239/423 |
| 909,190 | 1/1909 | Keller | 239/423 |
| 928,886 | 7/1909 | Scrimgeour | 239/426 |
| 1,159,314 | 11/1915 | Bartlett | 239/423 |
| 3,421,699 | 1/1969 | Babington et al. | 239/434 |
| 3,425,058 | 1/1969 | Babington | 239/434 |

FOREIGN PATENT DOCUMENTS

| | | | |
|---|---|---|---|
| 1529058 | 10/1978 | United Kingdom | 239/426 |

*Primary Examiner*—Andres Kashnikow
*Assistant Examiner*—Michael J. Forman
*Attorney, Agent, or Firm*—Foley & Lardner, Schwartz, Jeffery, Schwaab, Mack, Blumenthal & Evans

[57] ABSTRACT

A one-piece high-solids nebulizer has a body which, in use, is substantially horizontal, and has an upright groove formed across one end. Extending through the body are a gas passage and, above it, a parallel liquid passage of larger cross-sectional area, each terminating in an outlet orifice opening into the groove. A gas inlet to the gas passage may be connected to a source of gas under pressure, and a liquid inlet to the liquid passage may be connected to a source of liquid under pressure and to be nebulized. The body is tapered to both sides of the groove to reduce the area of the body bordering the groove, and this end of the body is also bevelled from below to reduce the depth of the groove below the gas outlet orifice.

4 Claims, 1 Drawing Sheet

ONE-PIECE HIGH-SOLIDS NEBULIZER

BACKGROUND OF THE INVENTION

This invention relates to an improved nebulizer, and it has more particular reference to a Babington type nebulizer used, for example, in spectroscopic analysis.

A nebulizer of this type ordinarily has a first nozzle through which an inert gas, such as argon, is expelled under high pressure into a spray chamber, and a second nozzle through which a liquid to be nebulized is directed under pressure from a peristaltic pump to the high velocity gas stream. The positional relationship of the two nozzles is critical, and even when this is correct, results are sometimes unsatisfactory due to clogging of the nozzles and the presence of inadequately nebulized droplets of the liquid under treatment.

The present invention has been devised with the general object of providing a nebulizer of the Babington type in which the optimum relationship of the two nozzles for a particular solution and gas is predetermined and fixed, and which will be found effective in producing a homogeneously nebulized liquid. Nebulizers according to the invention may be simple and inexpensive to manufacture and trouble-free in use.

SUMMARY OF THE PRESENT INVENTION

With the foregoing and other objects in view, the invention resides broadly in a nebulizer generally of the type set out and including a normally horizontal body formed with an upright groove at one end, a gas passage in the body and, above it, a parallel liquid passage of larger cross-sectional area, each of these passages in the body terminating in an outlet orifice opening into the groove, a gas inlet to the gas passage for connection to a source of gas under pressure, and a liquid inlet to the liquid passage for connection to source of liquid under pressure to be nebulized, said one end of the body being tapered from both sides of the groove, reducing the area of the body bordering it, said end of the body being bevelled to reduce the depth of said groove below the gas outlet orifice. Other features of the invention will become apparent from the following description.

BRIEF DESCRIPTION OF THE DRAWINGS

A preferred embodiment of the invention is shown in the accompanying drawings, wherein.

DETAILED DESCRIPTION OF THE PREFERRED EMBODIMENT

Figure 1:
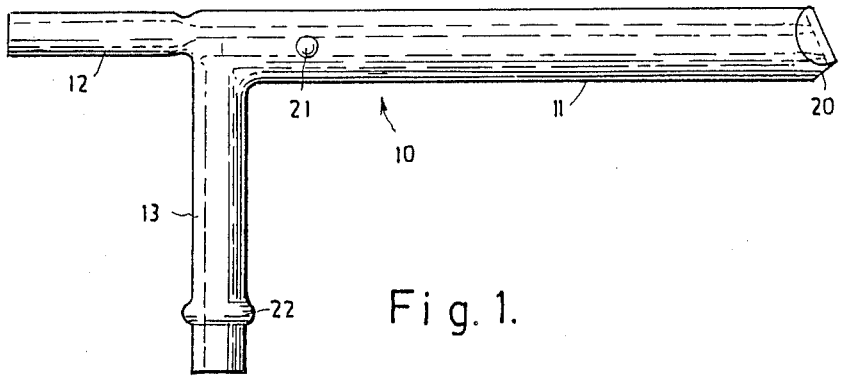
FIG. 1 is a side elevational view of a nebulizer according to the invention.
Figure 2:
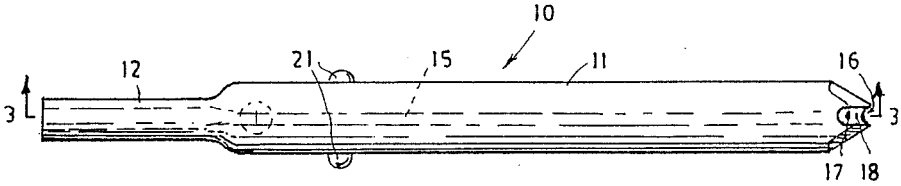
FIG. 2 is a plan view of the nebulizer.

The nebulizer includes a body 10 which, in this embodiment, is of glass, though other substances such as ceramic or plastics material may be suitable to some applications. The body 10 is made up of a section 11 of dual-bore glass tube, a first single-bore glass tube section 12 and a second single-bore glass tube section 13 of larger diameter.

In the construction of the nebulizer the section 11 of dual-bore glass tube is heated at one end to constrict both its bores at and near to that end. At its other end, the first section 12 of single-bore glass tube is connected to lead into the other bore of the dual-bore tube, forming a liquid passage 15 from end to end of the body 10 for the introduction of a sample to be nebulized.

The bore 14 of the dual-bore section is tapped at or near to its inner end and the second single-bore section 13 is joined more or less perpendicularly to the body 10 so that its bore forms, with the bore 14, the gas passage of the nebulizer.

Figure 3:
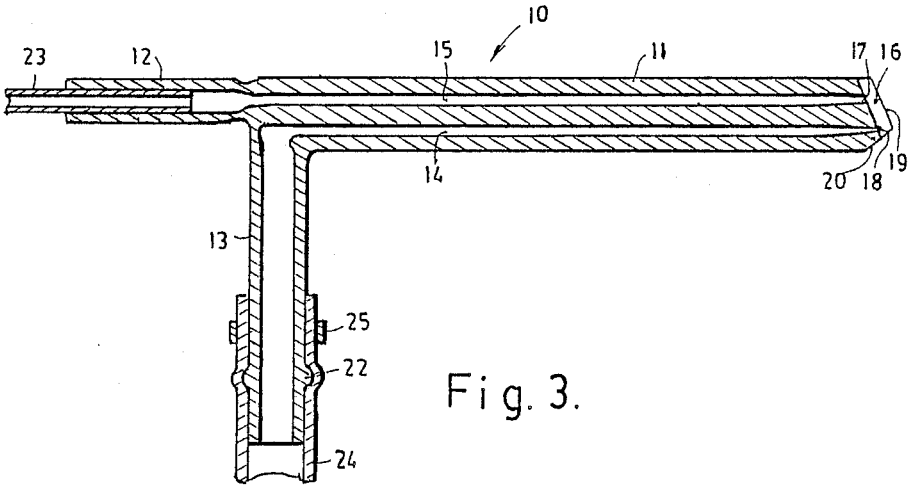
FIG. 3 is a sectional view of the nebulizer taken along line 3—3 in FIG. 2.

A groove 16 is cut in the distal end of the dual-bore section 11, at an angle of about 75° to the axis of the section. The groove intersects the bores 15 and 14 and it is cut to such a depth that a gas flow of approximately 0.8 L/min at 280 kpa is achieved through the gas passage 14. Owing to the obliquity of the groove 16 the constriction of the bore 15 is removed or substantially reduced and the liquid outlet orifice 17 is of greater diameter than the gas outlet orifice 18. The distal end of the dual-bore section 11 is tapered or cut away to both sides of the groove 16 to reduce the surface areas of the glass immediately adjacent to the groove to narrow strips or shoulders 19. This end of the section 11 is also cut obliquely from below, as indicated at 20 in FIGS. 1 and 3.

A pair of diametrically opposed projections or stops 21 are applied to the body 10 a short distance ahead of the gas inlet tube 13, and a circumferential bead 22 is formed about this tube near to its distal end.

In using the nebulizer, a liquid supply line 23 is inserted closely into the bore of the single-bore section 12, and a gas line 24 is fitted over the single-bore section 13 and secured and sealed by a clamp ring 25. The nebulizer body is inserted closely through an aperture leading to a spray chamber (not shown) of well-known type until brought to rest by the stops 21. Gas is fed under pressure through the gas line 24 and liquid to be nebulized is fed from a peristaltic or other suitable pump (not shown) through the liquid supply line 23. Liquid expelled from the liquid outlet orifice 17 into the groove 16 is entrained and nebulized by the high-velocity gas expelled through the gas outlet orifice 18 and is directed to a more or less spherical or convex breaker member (not shown) within the chamber to assist in breaking up any oversize droplets of the liquid. Any droplets which may fall to the bottom of the spray chamber are drained away, and the nebulized liquid is conveyed from the chamber to a torch (not shown) for spectroscopic analysis in usual manner.

I claim:

1. A glass spectroscopic nebulizer including:

a tubular glass body having a longitudinal axis and formed with a groove across one end, a gas passage and a parallel liquid passage formed in the body, both parallel to the longitudinal axis of said body and terminating in outlet orifices opening into the groove, said orifices when formed being constricted in diameter, said passages gradually increasing in diameter away from said orifices to assume full diameter, said liquid orifice being above said gas orifice a gas inlet to the gas passage for connection to a source of gas under pressure, and a liquid inlet to the liquid passage for connection to a source of liquid under pressure to be nebulized, and wherein said groove extends obliquely to form an acute angle with the longitudinal axis of said body and with said passages, the depth and angle of the groove being such as to retain the constricted orifice of gas passage while removing the constriction from the other passage, whereby fluid expelled from the non-constricted liquid passage is entrained and nebulized by gas expelled from the constricted orifice.

2. A glass spectroscopic nebulizer as claimed in claim 1 wherein said one end of the body is tapered rearwardly from both sides of the groove thereby reducing the area of the body bordering it.

3. A nebulizer according to claim 2 wherein said body is normally horizontal, and said end of the body is bevelled below said gas outlet orifice to reduce the length of the groove.

4. A nebulizer according to claim 3 wherein said body includes a first section of single bore tube integral with said body, its bore leading coaxially into one bore of said dual-bore section to form the liquid passage, and a second section of single bore tube integral with the body, its bore leading substantially perpendicularly into the other bore of said double-bore section to form the gas passage.

* * * * *